US010994902B2

(12) United States Patent
Cheng

(10) Patent No.: US 10,994,902 B2
(45) **Date of Patent: *May 4, 2021**

(54) CONTAINER WITH AN ELASTIC SPOUT

(71) Applicant: Zhejiang Haoda Science & Technology Co., Ltd, Jinhua (CN)

(72) Inventor: Haojun Cheng, Jinhua (CN)

(73) Assignee: ZHEJIANG HAODA SCIENCE & TECHNOLOGY CO., LTD, Jinhua (CN)

( * ) Notice: Subject to any disclaimer, the term of this patent is extended or adjusted under 35 U.S.C. 154(b) by 46 days.

This patent is subject to a terminal disclaimer.

(21) Appl. No.: 16/416,167

(22) Filed: May 18, 2019

(65) Prior Publication Data

US 2020/0095031 A1 Mar. 26, 2020

(30) Foreign Application Priority Data

Sep. 25, 2018 (CN) ..... 201811116582.4
Sep. 25, 2018 (CN) ..... 201821567053.1
Jan. 16, 2019 (CN) ..... 201910041649.0

(51) Int. Cl.
*B65D 47/20* (2006.01)
*A45F 3/18* (2006.01)
(Continued)

(52) U.S. Cl.
CPC ..... *B65D 47/20* (2013.01); *A45F 3/18* (2013.01); *A47G 19/2272* (2013.01);
(Continued)

(58) Field of Classification Search
CPC ..... A47G 19/2222; A47G 19/2205; A47G 19/2266; A47G 19/2272; A47G 21/185;
(Continued)

(56) References Cited

U.S. PATENT DOCUMENTS

2012/0187075 A1* 7/2012 El-Saden ..... B65D 51/242 215/389
2015/0164254 A1* 6/2015 Niedens ..... A61G 7/05 220/714
(Continued)

FOREIGN PATENT DOCUMENTS

CA 2925943 A1 * 4/2015 ..... A47G 19/2266
WO WO-2008131437 A1 * 10/2008 ..... B65D 47/066
WO WO-2019038269 A1 * 2/2019 ..... B65D 47/2037

*Primary Examiner* — J. Gregory Pickett
*Assistant Examiner* — Sanjidul Islam

(57) ABSTRACT

The present disclosure discloses a container including a lid further including a lid body and a container body connected to the lid. The lid body is provided an elastic spout attached to the lid body and a limiting seat mounted at the top surface of the lid body; a linking part is mounted on the elastic spout, and a locking part cooperating with the linking part is disposed on the limiting seat; a lock release drive mechanism that drives the linking part and the locking part to be unlocked is slidably mounted on the lid body; the elastic spout has a folded storage state where the linking part and the locking part are interlocked and has a full release state in which the linking part is disengaged from the locking part to enable the elastic spout to be unfolded. The container is easy to assemble, easy to use, safe and hygienic.

14 Claims, 10 Drawing Sheets

(51) Int. Cl.

| | |
|---|---|
| ***A47G 19/22*** | (2006.01) |
| ***B65D 23/10*** | (2006.01) |
| ***B65D 43/02*** | (2006.01) |
| ***B65D 47/06*** | (2006.01) |

(52) U.S. Cl.
CPC ..... *B65D 23/102* (2013.01); *B65D 43/0225* (2013.01); *B65D 47/066* (2013.01); *B65D 2547/063* (2013.01)

(58) Field of Classification Search
CPC ..... A47G 21/18; A47G 19/22; B65D 47/065; B65D 47/066; B65D 47/2037; B65D 51/242
USPC ..... 220/708
See application file for complete search history.

(56) References Cited

U.S. PATENT DOCUMENTS

| | | | | |
|---|---|---|---|---|
| 2015/0173539 | A1* | 6/2015 | Mason | B65D 47/063 220/707 |
| 2017/0208974 | A1* | 7/2017 | Zhang | F16K 7/066 |
| 2017/0253394 | A1* | 9/2017 | Fogarty | A45F 3/16 |
| 2019/0177049 | A1* | 6/2019 | Farsai | A47G 21/185 |
| 2019/0263572 | A1* | 8/2019 | Keung | B65D 21/0228 |
| 2020/0255192 | A1* | 8/2020 | Choi | A45F 3/20 |

* cited by examiner

CONTAINER WITH AN ELASTIC SPOUT

CROSS-REFERENCE TO RELATED APPLICATIONS

This application claims all benefits accruing under 35 U.S.C. § 119 from China Patent Application No. 201910041649.0, filed on Jan. 16, 2019, 201811116582.4, filed on Sep. 25, 2018, and 201821567053.1, filed on Sep. 25, 2018, in the State Intellectual Property Office of China, the content of which is hereby incorporated by reference.

TECHNICAL FIELD

The present disclosure relates to daily necessities, in particular to a container.

BACKGROUND

In the prior art, a container with a spout is widely used. The container generally includes a lid and a container body connected to each other. The spout is inserted and fixed on the lid, and the lid of some containers is further provided with a flip cover. The spout is indirectly abutted by the movement of the flip cover, so that the spout becomes bent and folded. An interoperable locking mechanism may be arranged between the lid and the flip cover to maintain the folded or storage state of the spout. However, the flip cover is generally reset with a metal spring. Thus, the structure is complicated and there is a potential hazard in hygiene and safety.

SUMMARY

In order to provide a container, which is simple in structure, easy to clean, and convenient to use, an embodiment of the present disclosure includes a container including a lid and a container body connected to the lid, the lid including a lid body, wherein the lid body is further provided with an elastic spout extending away from the lid body and a limiting seat mounted at the top of the lid body. A linking part is mounted on the elastic spout, and a locking part cooperating with the linking part is disposed on the limiting seat. A lock release drive mechanism that drives the linking part and the locking part to be unlocked is slidably mounted on the lid body. The elastic spout has a folded storage state, and the linking part and the locking part are interlocked with each other in the folded storage state. The elastic spout also has a full release state in which the linking part is disengaged from the locking part to enable the elastic spout to be unfolded.

Furthermore, the elastic spout is provided with a fixing sleeve rotatably mounted on the lid body, and the linking part is rotatably mounted on the fixing sleeve.

Furthermore, the limiting seat is provided with a slideway, the outer wall of the fixing sleeve is provided with a guiding shaft extending into the slideway, and the guiding shaft is rotatably and slidably mounted in the slideway. The linking part is released from the locking part by a movement of the guiding shaft in the slideway.

Furthermore, two slideways are oppositely disposed, and two guiding shafts are respectively and slidably disposed in each of the slideways, and the two guiding shafts are disposed coaxially on both radial sides of the fixing sleeve.

Furthermore, the limiting seat is a U-shape structure that is horizontally fixed on the top of the lid body, and the limiting seat includes a first sidewall, a second sidewall, and a third sidewall. The first sidewall and the second sidewall are oppositely disposed and the third sidewall is connected between the first sidewall and the second sidewall. The two slideways are respectively disposed adjacent to the first sidewall and the second sidewall, the locking part is disposed at the third sidewall, and the elastic spout is installed within the area surrounded by the U-shape structure.

Furthermore, the lock release drive mechanism includes a sliding support and a lock release button coupled to the sliding support, the sliding support being interconnected to the fixing sleeve.

Furthermore, the sliding support includes a sliding plate that cooperates with the top surface of the lid body and a transmission part that is fixedly connected to the sliding plate and rotatably cooperated with the fixing sleeve. The lock release button is connected to the side edge of the sliding plate, and the lock release button is bent relative to the sliding plate and extends to the outer peripheral surface of the lid body.

Furthermore, the transmission part includes two supporting arms respectively provided with shaft holes. The two guiding shafts extend into the slideway after movably piercing through the corresponding shaft holes.

Furthermore, the elastic spout includes a liquid inlet at one end and a liquid outlet at the other end. The one end with the liquid inlet is fixed to the lid body, the other end with the liquid outlet pierces through the fixing sleeve and an anti-off head subject to the fixing sleeve is disposed at the piercing portion.

Furthermore, a rotation axis of the guiding shaft and a rotation axis of the linking part are parallel and offset from each other. The rotation axis of the linking part is closer to the liquid outlet of the elastic spout, compared to the rotation axis of the guiding shaft.

Furthermore, the linking part is a cover plate, and the cover plate blocks the liquid outlet of the elastic spout when the elastic spout is in the folded storage state.

Furthermore, at least one section of the elastic spout is an elastic segment for driving the elastic spout to be unfolded, and the elastic segment closes the cavity by self-bending when the elastic spout is in the folded storage state. One side of the fixing sleeve adjacent to the liquid outlet is a top edge and the anti-off head abuts the top edge, and the other side of the fixing sleeve is a bottom edge, the elastic segment is bent around the bottom edge of the fixing sleeve and is tensioned in the folded storage state. The elastic segment of the tensioned state drives the linking part and the locking part to be in the interlocked state.

Furthermore, the locking part is a locking tongue that is abutted against the top surface of the linking part when being interlocked.

Furthermore, the limiting seat further includes a limiting element configured for limiting a rotating angle of the fixing sleeve, the elastic spout further has a partial release state in which the limiting element rotates within the rotating angle to enable the elastic spout to be partially released.

Furthermore, the limiting element extends towards the fixing sleeve and forms a limiting portion, the limiting portion abuts the fixing sleeve and limits the rotation angle of the fixing sleeve, so that the elastic spout reaches the partial release state. The lock release drive mechanism removes the abutment of the fixing sleeve from the limiting portion to enable the elastic spout to release from the partial release state to the full release state.

The container according to the present disclosure is configured to lock and release the elastic spout by providing cooperation between the linking part, the elastic spout, the lock release drive mechanism and the limiting seat, thus making the elastic spout of the container safer and more sanitary in assembly and operation. The container as a whole is easy to use and clean, and the service life of the container may be extended accordingly.

DETAILED DESCRIPTION

Figure 1:
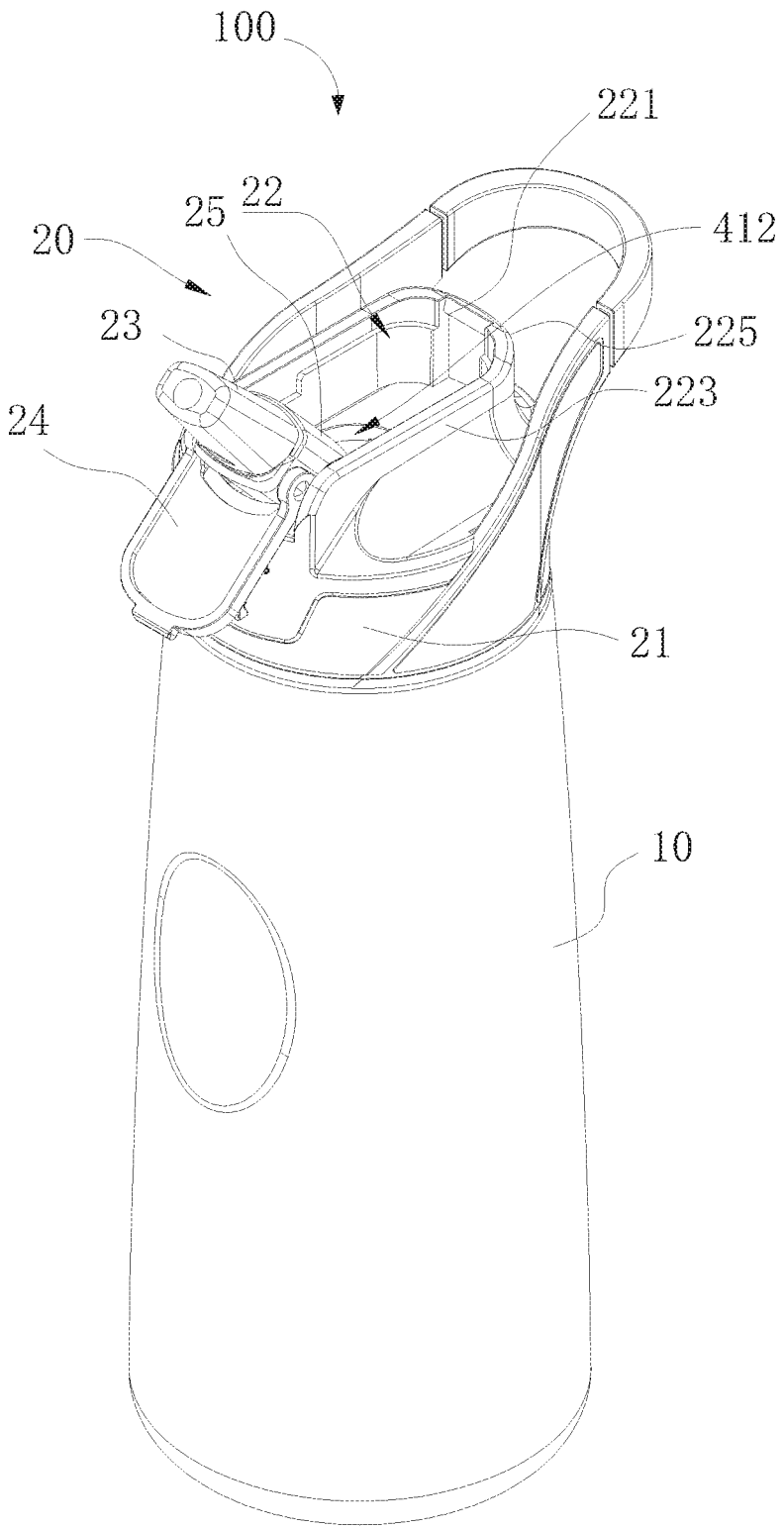
FIG. 1 is a perspective view of a container according to an embodiment of the present disclosure.

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when an element is referred to as being "fixed" to another element, it may be directly attached to the other element or a further element may be presented between them. When an element is considered to be "connected" to another element, it may be directly connected to the other element or connected to the other element through a further element (e.g., indirectly connected). The terms as used herein "vertical", "horizontal", "left", "right", and the like, are for illustrative purposes only and are not meant to be the only orientation.

Unless otherwise defined, all technical and scientific terms used herein have the same meaning as a skilled person in the art would understand. The terminology used in the description of the present disclosure is for the purpose of describing particular embodiments and is not intended to limit the disclosure.

Referring to FIG. 1 to FIG. 7, embodiments of the present disclosure include a container 100 including a container body 10 and a lid 20 connected to the container body 10, wherein the lid 20 includes a lid body 21, a limiting seat 22, an elastic spout 23 and a linking part 24. The elastic spout 23 is inserted on the lid body 21. The limiting seat 22 is provided with a locking part 221 that cooperates with the linking part 24. A lock release drive mechanism 40 that drives the linking part 24 and the locking part 221 to be unlocked is slidably mounted on the lid body 21.

The lock release drive mechanism 40 may be a single component or a plurality of components. The linking part 24 and the locking part 221 are interlocked with each other. When the linking part 24 changes in position or is deformed, the interlocked state together with the locking part 221 may be released. The lock release driving mechanism 40 may reciprocally slide relative to the lid body 21 for easy operation, and the linking part 24 is directly or indirectly driven to release the interlocked state with the locking part 221 during the sliding process.

The container body 10 and the lid body 21 may be sealed and connected by ways of a threaded engagement or the like. The limiting seat 22 is located at the top of the lid body 21 and is fixedly mounted with the lid body 21, for example, by bonding or screwing. Alternatively, the limiting seat 22 and the lid body 21 are of a unitary structure.

The elastic spout 23 is arranged for draining the liquid in the container body 10. One end of the elastic spout 23 is connected to the lid body 21, for example, by sealing, clamping and the like, and may extend into the container body 10. Thus, one could drink liquid by tipping or sucking according to a need as to whether to extend or according to the length of extension. The other end of the elastic spout 23 includes a liquid outlet.

The linking part 24 is connected to the elastic spout 23. They may be directly connected or indirectly connected with each other, and not only in contact with each other. The linking part 24 and the elastic spout 23 may be fixedly connected. In other words, when one moves, the other one will follow. The linking part 24 may also be rotatably coupled with the elastic spout 23. For example, a shaft 256 is directly or indirectly mounted on the elastic spout 23, and the linking part 24 is mounted on the elastic spout 23 through the shaft 256.

The elastic spout 23 may be deformed, and thus may have a folded storage state. In the storage state, the linking part 24 and the locking part 221 are interlocked with each other. The elastic spout 23 further has a full release state where the linking part 24 could be disengaged from the locking part 221 to enable the elastic spout 23 to be unfolded.

When the container 100 is not in use, in order to keep the elastic spout 23 in the folded storage state, the limiting seat 22 is provided with a locking part 221 that cooperates with the linking part 24, and the liquid outlet of the elastic spout 23 is limited in the lid body 21. When the user opens the linking part 24 through the lock release drive mechanism 40, the elastic spout 23 is reset by its own elastic force. Thus, the inside of the cavity is unblocked, and the liquid outlet is also turned up for the user to drink.

In one embodiment, the outer edge of the lid body 21 has a flange. The inner edge of the flange is provided with an internal thread and is connected to the container body 10 by a threaded engagement. It is understood that in other embodiments, the lid body 21 and the container body 10 may be connected by other means. For example, a corresponding boss is directly provided on the container body 10 and the lid body 21, and the connection is provided by snap fit. A gasket may be added at the joint between the container body 10 and the lid body 21 to increase the sealing property.

The lid body 21 serves as a base body for mounting the elastic spout 23 and the limiting seat 22. The top surface of the lid body 211 is provided with a through hole 212 for fixing and inserting the elastic spout 23. The inner wall of the through hole 212 extends along the axis of the lid body 21 to the direction of the container body 10 with a predetermined distance. The contact area with the elastic spout 23 is increased. The inner diameter of the through hole 212 is adapted to and is tightly connected to the elastic spout 23 to avoid liquid leakage at the joint.

Preferably, the top surface of lid body 211 further includes a vent hole (unlabeled) connected with the outside. When liquid is filled in the container 100, the vent hole (unlabeled)

maintains the internal and external pressures consistently, so that the user may smoothly drain the liquid in the container 100 through the elastic spout 23.

In one of the embodiments, the outer sidewall of the lid body 21 is provided with a protruding anti-slip pattern for enhancing the friction between the lid body and the user's hand, so that the user may easily unscrew the lid 20.

In one embodiment, one end of the elastic spout 23 is further sleeved with a fixing sleeve 25. The fixing sleeve 25 is rotatably mounted on the lid body 21, for example, and may be directly or indirectly mounted on the lid body 21. The linking part 24 is rotatably mounted on the fixing sleeve 25, and the fixing sleeve 25 is rotated to drive or enable the elastic spout 23 to fold.

In one of the embodiments, the lock release drive mechanism 40 includes a sliding support 41 and a lock release button 42 coupled to the sliding support 41, the sliding support 41 being interconnected to the fixing sleeve 25. The lock release button 42 drives the sliding support 41 to slide, and drives the fixing sleeve 25 and the elastic spout 23 to move. At the same time, the linking part 24 connected on the elastic spout 23 is driven to move in the direction away from the locking part 221 to release the interlocked state between the linking part 24 and the locking part 221.

The lock release button 42 and the sliding support 41 may be of a unitary structure or may be separate structures in a fixed connection.

In one embodiment, the sliding support 41 includes a sliding plate 411 that cooperates with the top surface of the lid body 21 and a transmission part 413 that is fixedly connected to the sliding plate 411 and that is rotatably cooperated with the fixing sleeve 25. The sliding plate 411 is horizontally placed on the top surface of the lid body 21. The lock release button 42 drives the sliding plate 411 to move in a direction parallel to the top surface of the lid body 21 and drives the transmission part 413 and the fixing sleeve 25 to move. Preferably, the lock release button 42 is connected to the side edge of the sliding plate 411. Thus, the purpose of pushing the sliding plate 411 to move along the top surface of the lid body 21 is achieved. The lock release button 42 is bent relative to the sliding plate 411 and extends to the outer peripheral surface of the lid body 21, i.e., the outer side of the flange of the lid body 21. The outer peripheral surface of the lid body 21 is correspondingly provided with a button slot 214 for providing drive space of accommodating and pressing the lock release button 42.

It may be understood that in other embodiments, the installation position and form of the lock release driving mechanism 40 may be, for example, a dial block directly connected to the fixing sleeve 25 or the linking part 24 to drive the fixing sleeve 25 or the linking part 24. The dial block drives the fixing sleeve 25 or the linking part 24 to release the locking state of the linking part 24 and the locking part 221. The dial block is slidably mounted directly or indirectly relative to the lid body 21.

Preferably, the sliding plate 411 has an open area 412 for avoiding the elastic spout 23. One side of the sliding plate 411 avoids the open area 412, and further extends from the two sides of the open area 412 in its sliding direction, thereby obtaining a larger length and improving the stability of sliding.

The fixing sleeve 25 is made of a material having certain hardness, such as plastic, to drive or enable the elastic spout 23 to bend.

The fixing sleeve 25 is sleeved on the elastic spout 23. They may be of a unitary structure, or the fixing sleeve 25 may also be a separate structure. When the fixing sleeve 25 is a separate structure, individual portions of the separate structure are circumferentially arranged around the elastic spout 23 and fastened to each other. It is more convenient to assemble the fixing sleeve 25 in the separate structure.

Preferably, the liquid inlet of the elastic spout 23 is inserted into the lid body 21, and the liquid outlet of the elastic spout 23 pierces through the fixing sleeve 25. An anti-off head 233 which is limited by the fixing sleeve 25 is disposed at the piercing portion. The inner diameter of the anti-off head 233 is slightly larger than the inner diameter of the fixing sleeve 25 to prevent the liquid outlet from coming out of the fixing sleeve 25 during the locking process.

In one embodiment, one side of the fixing sleeve 25 adjacent to the liquid outlet is a top edge 254, and the anti-off head 233 abuts the top edge 254. The other side of the fixing sleeve 25 is a bottom edge 255. In the folded storage state, the elastic spout 23 is bent around the bottom edge 255 of the fixing sleeve 25 and is in a tension state. The elastic spout 23 in the tension state drives the linking part 24 and the locking part 221 to be in an interlocked state.

In one of the embodiments, an elastic segment 231 of the elastic spout 23 is between the top edge 254 and the bottom edge 255 of the fixing sleeve 25. The elastic segment 231 is cooperated with a location of the bottom edge 255 of the fixing sleeve 25.

In one embodiment, the fixing sleeve 25 is rotatably mounted around a first axis 251 on the lid body 21, and the rotation axis of a guiding shaft 253 is the first axis 251. The linking part 24 is rotatably mounted around a second axis 252 on the fixing sleeve 25, and the rotation axis of the linking part 24 is the second axis 252. The first axis 251 and the second axis 252 are parallel to each other. Preferably, the first axis 251 and the second axis 252 are arranged offset. Preferably, the second axis 252 is closer to the liquid outlet of the elastic spout 23, compared to the first axis 251.

In one of the embodiments, the limiting seat 22 is provided with a slideway 228 for guiding the movement path of the elastic spout 23 directly or indirectly. The slideway 228 may be two slideways which are oppositely arranged.

In one embodiment, the opposite sides of the outer wall of the fixing sleeve 25 is provided with a guiding shaft 253 extending into the slideway 228 of the limiting seat 22. The number of the guiding shafts 253 is the same as the number of the slideways 228. The guiding shaft 253 correspondingly extends into the respective slideways 228. Preferably, the number of the guiding shafts 253 is two, and the two guiding shafts 253 are coaxially arranged on both radial sides of the fixed fixing sleeve 25. The fixing sleeve 25 is arranged for rotatably and slidably mounting the elastic spout 23 on the lid body 21. That is, the fixing sleeve 25 is rotatably mounted and slidably mounted on the limiting seat 22 which is connected to the lid body 21. The guiding shaft 253 is arranged to guide the sliding direction of the fixing sleeve 25. The guiding shaft 253 rotates around the first axis 251 within the slideway 228. During the unlocking or releasing process of the elastic spout 23, while the guiding shaft 253 slides in the slideway 228, the position of the first axis 251 changes with the position of the guiding shaft 253.

Preferably, the limiting seat 22 is a U-shape structure 222 that is horizontally fixed on the top of the lid body 21. The limiting seat 22 includes a first sidewall 223 and a second sidewall 224 which are oppositely disposed, and a third sidewall 225 which is connected between the first sidewall 223 and the second sidewall 224. The limiting seat 22 is horizontal, which may be understood as the opening direction of a U-shape is the radial direction of the container body 10 (or the lid body 21). That is, the opening direction of the U-shape has a substantially horizontal orientation in a normal state.

In one of the embodiments, the slideways 228 are respectively disposed adjacent to the first sidewall 223 and the second sidewall 224, and the elastic spout 23 is installed in the area surrounded by the U-shape structure 222, i.e., the storage area 226. A portion of the elastic spout 23 may be placed in the slideway 228, or the guiding shaft 253 of the fixing sleeve 25 on the elastic spout 23 may be inserted into the slideway 228. By the above manner, the slideway 228 may be used to define the movement path of the elastic spout 23. At least the movement path of local position of the elastic spout 23 may be defined, so that the elastic spout 23 is bent according to a predetermined axis portion when switching between the storage state and the full release state. Furthermore, the angle of the bending may be defined.

Preferably, the third sidewall 225 is provided with a locking part 221 for fastening with the linking part 24. The linking part 24 cooperates with the locking part 221 to take in the elastic spout 23 in the storage area 226 of the limiting seat 22. Preferably, the locking part 221 is a locking tongue extending towards the opening of the U-shape, and the locking tongue is used for abutting against the top surface of the linking part 24 to lock the elastic spout 23.

The transmission part 413, which is rotatably cooperated with the fixing sleeve 25, is fixed on the sliding support 41. Preferably, the transmission part 413 includes two supporting arms, and the two supporting arms are respectively provided with shaft holes 414. The two guiding shafts 253 extend into the slideway 228 after movably piercing through the corresponding shaft holes 414.

A sliding plate slot 223*a* for accommodating the sliding plate 411 is disposed at a joint of the lid body 21 and the first sidewall 223, the second sidewall 224 and the third sidewall 225. The sliding plate slot 223*a* is arranged for accommodating the sliding plate 411 and the sliding plate 411 slides along the top surface of the lid body 21.

Preferably, on each of the first sidewall 223 and the second sidewall 224 are further provided with a positioning step 227. When the elastic spout 23 is in the folded storage state, the edge of the linking part 24 is placed on the positioning step 227. The positioning step 227 is used to define the depth at which the linking part 24 is rotated within the U-shape structure 222.

In one of the embodiments, when the limiting seat 22 and the lid body 21 are separate structures and are capable of being fixed to each other, the first sidewall 223 and the second sidewall 224 are further provided with a guiding slot 229 communicated with the corresponding slideway 228 for mounting the guiding shaft 253. Each guiding slot 229 extends to a portion where its sidewall and the lid body 21 intersect. The guiding slot 229 facilitates the mounting of the guiding shaft 253 into the slideway 228, and the lid body 21 is provided with a limiting step 213 which inserts into the guiding slot 229. The limiting step 213 avoids the guiding shaft 253 moving from the guiding slot 229 when the lid body 21 is fixedly mounted with the limiting seat 22.

In order to improve the structural stability of the first, second and third sidewalls 223, 224, 225, a fixing plate 30 may be disposed on the limiting seat 22. The U-shape structure 222 formed by the first, second and third sidewalls 223, 224, 225 is horizontally fixed on the fixing plate 30. Moreover, the U-shape structure 222 and the fixing plate 30 may also be an integral structure. The area on the fixing plate 30 corresponding to the position of the storage area 226 is a hollow structure, which facilitates the installation and spares the elastic spout 23 and the vent hole (unlabeled). The outer edge of the fixing plate 30 may extend radially to the edge, or further extend downward to wrap the edge of the lid body 21, or at least partially wrap the edge of the lid body 21. The bottom surface of the fixing plate 30 and the top surface of the lid body 211 are fixed to each other to enhance the connection strength between the limiting seat 22 and the lid body 21. Preferably, a portion of the outer edge of the fixing plate 30 that wraps around the edge of the lid body 21 establishes a button opening 31 at the button slot 214 of the lid body 21, and the button opening 31 is for exposing the lock release button 42.

In one embodiment, the elastic spout 23 is fixedly inserted into the through hole 212 of the lid body 21. The elastic spout 23 has a liquid inlet at one end thereof. The liquid inlet is closely adhered to the inner wall of the through hole 212 and may be further sealed by the sealing ring to improve the sealing property of the joint area. The elastic spout 23 has a liquid outlet at the other end. When the elastic spout 23 is in the folded storage state, the liquid outlet is obturated in the storage area 226; when the elastic spout 23 is in the full release state, the liquid outlet is ejected from the storage area 226.

In one embodiment, the liquid inlet of the elastic spout 23 is further provided with a joint 232 adapted to the shape of the through hole 212 of the lid body 21. The joint 232 is clamped in the through hole 212 of the lid body 21. The joint 232 may be made of an elastic material and integrated with the elastic spout 23. The joint 232 and the elastic spout 23 may also be separate structures, and it is fixedly attached to one end of the elastic spout 23 and abuts against the inner wall of the through hole 212. The joint 232 may enhance the tightness of the connection between the joint 232 and the inner wall of the through hole 212, and also enhance the firmness of insertion of the elastic spout 23 on the lid body 21, thus enhance the sealing performance of the container 100 as a whole.

Preferably, the joint 232 is inserted with a bottom inserting tube 234 extending toward the bottom of the container body 10, or the bottom inserting tube 234 and the elastic spout 23 are of a unitary structure. The bottom inserting tube 234 is used to drain the liquid at the bottom of the container body 10.

In one of the embodiments, at least one section of the elastic spout 23 is an elastic segment 231 for driving the elastic spout 23 to be unfolded. The elastic segment 231 closes the cavity by self-bending when the elastic spout 23 is in the folded storage state. Preferably, the elastic segment 231 of the elastic spout 23 is disposed at a position close to the liquid outlet. The elastic segment 231 enables the elastic spout 23 to have a folded storage state that is relatively bent and a full release state that is unfolded by its own elastic force.

In one embodiment, in the unlocked or full release state, the portion of the elastic spout 23 exposing the lid body 21 is inclined with the axis of the lid body 21. The inclined elastic spout 23 and the top surface of the lid body 211 will form an obtuse angle. The elastic spout 23 and the top surface of the lid body 211 may be regarded as the two sides of the obtuse angle. The elastic spout 23 is folded towards the other side of the obtuse angle when it is bent, as shown in FIG. 1. Since the angle is an obtuse angle, the elastic spout 23 itself may obtain a larger deformation quantity when bending. It enables the elastic spout 23 to provide a larger resilient force when the linking part 24 is released from the folded storage state with the locking part 221.

The anti-off head 233, the elastic segment 231, the joint 232 and the bottom inserting tube 234 of the elastic spout 23 may be of a unitary structure, or may be partially or entirely in a separate structure. When the elastic spout 23 is in a separate structure, the mutual components are fixedly connected, and the internal cavities connect with each other when in the unfolded state.

The elastic spout 23 is made of a silicone material. It may be understood that the elastic spout 23 may also be made of other elastic materials.

In one of the embodiments, the linking part 24 is connected to the liquid outlet of the elastic spout 23 and is rotatably connected to the elastic spout 23. The linking part 24 is disengaged from the interlocking state with the locking part 221 by its own deformation or by the movement of the guiding shaft 253 in the slideway 228.

In one embodiment, the linking part 24 is a cover plate. When the elastic spout 23 is in the folded storage state, the cover plate may block the liquid outlet of the elastic spout 23 to block dust or foreign matter, and keep the liquid outlet portion clean.

Of course, if the barrier function is not strictly required, the shape of the linking part 24 is not strictly limited, and may be, for example, a plate shape, a strip shape, or the like.

The cover plate as the linking part 24 is moved in the slideway 228 by the guiding shaft 253 to release from the interlocking state with the locking part 221. Preferably, the cover plate is sized to fit into the storage area 226 of the U-shape structure 222. In the storage state, the cover plate is overlapped on the positioning step 227 of the U-shape structure 222.

One side of the cover plate is provided with two connecting ears 242 disposed opposite to each other, and the cover plate is rotatably connected to the elastic spout 23 through the two connecting ears 242. When the fixing sleeve 25 is used, the opposite radial sides of the fixing sleeve 25 may be disposed with the rotating shaft 256, and the two connecting ears 242 are rotatably sleeved on the corresponding one of the rotating shafts 256 to realize the rotation cooperation of the cover plate and the fixing sleeve 25. The axis of the rotating shaft 256 is the rotation axis of the linking part 24 (cover plate), i.e. the second axis 252. It is also possible that the rotating shaft 256 is fixed on the two connecting ear 242, and a shaft hole is disposed on opposite radial sides of the fixing sleeve 25 for inserting a corresponding rotating shaft 256.

The side of the cover plate away from the third sidewall 225 (in the storage state) is directly or indirectly rotatably connected to the elastic spout 23, and the side of the cover plate adjacent to the third sidewall 225 (in the storage state) is provided with a bump 241 which protrudes to the third sidewall 225, wherein the bump 241 is used to cooperate with the locking tongue to lock the elastic spout 23 to the folded storage state. In the storage state, the top surface of the bump 241 is against the locking tongue.

It may be understood that in other embodiments, the locking form may have other structures, such as a protruding locking hook disposed on the outer edge of the third sidewall 225 of the limiting seat 22. Correspondingly, the linking part 24 extends to the third sidewall 225 and is provided with a hook portion that cooperates with the locking hook. The purpose of interlocking the linking part 24 and the locking part 221 may be achieved. The rotational connection between the linking part 24 and the elastic spout 23 (or the elastic spout 23 is indirectly driven by the fixing sleeve 25) facilitates the linking part 24 to directly or indirectly drive the elastic spout 23, and switch between the storage state and the full release state for the elastic spout 23.

When in storage, the portion where the bump 241 first comes into contact with the locking tongue (the bottom edge of the bump 241 in the storage state) has a chamfered structure. When the bump 241 is guided to contact with the locking tongue through the inclined surface of the chamfered portion, the bump 241 slightly falls back. When the retreat happens, the back off space may be provided by the deformation of the cover plate itself or the movement of the guiding shaft 253 along the slideway 228. After the bump 241 is further pressed down over the locking tongue, the bump 241 extends below the locking tongue. That is, the locking tongue abuts the top surface of the bump 241 to keep in a locked state.

Similarly, a chamfered structure may be disposed on the locking tongue. That is, a portion where the locking tongue and the bump 241 first contact is formed with a slope, and the bump 241 is guided to be in position. The chamfered structures of both the locking tongue and the bump 241 may also be used in combination.

Preferably, the top surface of the linking part 24 is provided with a protruding anti-slip pattern. When the elastic spout 23 is folded, the hand does not slip easily when applying force on the linking part 24.

In one of the embodiments, the container body 10 is generally cylindrical and has a recess on the side of the container body 10 for a better grip. In other embodiments, the structure of the container body 10 and the material of the container body 10 are not strictly limited, as long as it may be tightly connected with the lid 20 and may hold liquid. The container body 10 may be a vacuum container body 10 having a double-layer structure. The container body 10 may also be a container body 10 of a single layer structure.

In one embodiment, the handle 26 is fixed directly on the lid 20 with a plastic ring handle wrapped with soft rubber. It is convenient for users to carry the container 100. It will be appreciated that in other embodiments, the handle 26 may be made of other flexible materials, such as a string.

Figure 2:
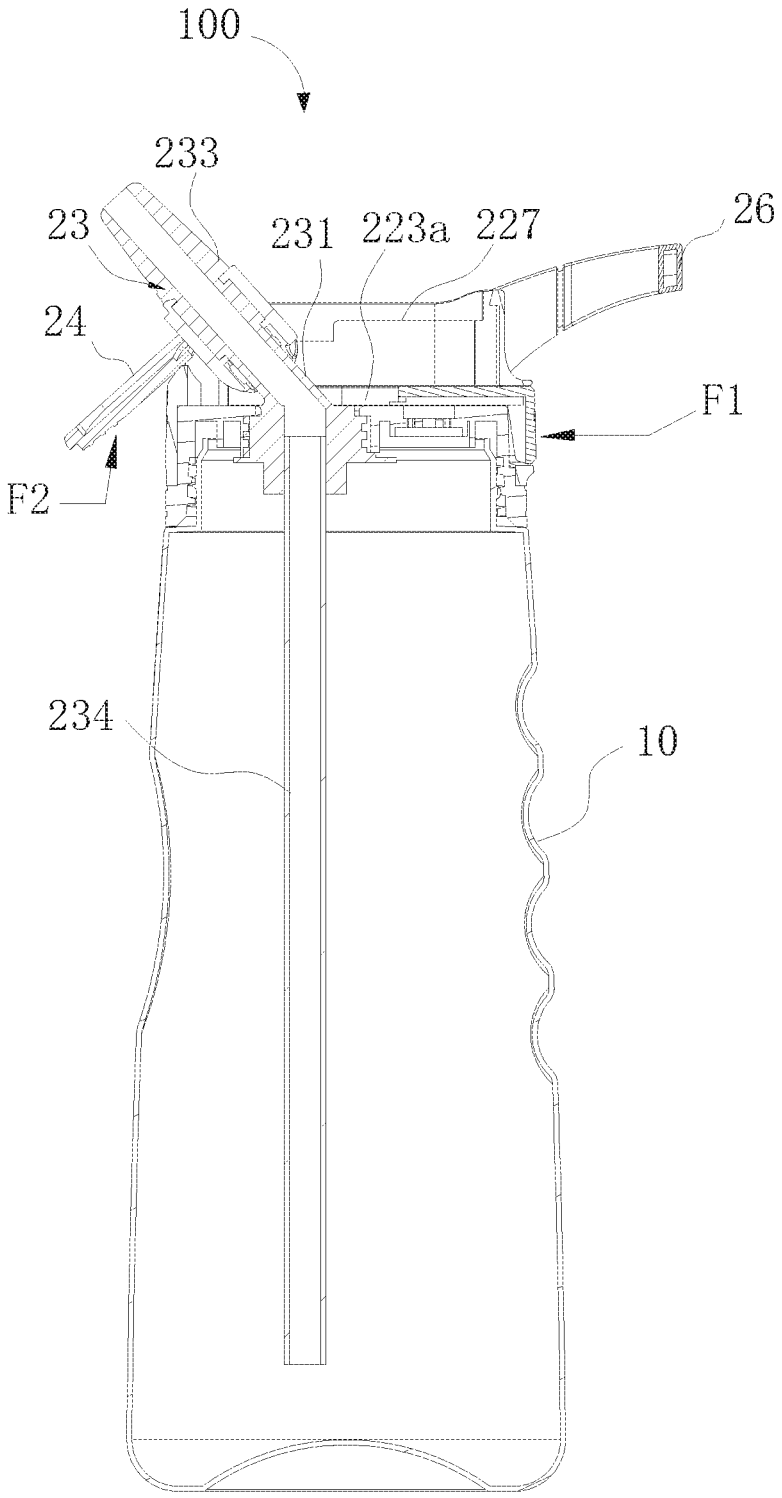
FIG. 2 is a cross-sectional view of the container shown in FIG. 1.

As shown in FIGS. 1 to 7, in a preferred embodiment, the working principle of the container 100 is as follows:

When the elastic spout 23 is in the unlocked or full release state, the user applies force on the top surface of the linking part 24 (cover plate) by the force application direction F2 as shown in FIG. 2. When the cover plate and the fixing sleeve 25 are in close contact with each other, the cover plate is further pushed to drive the fixing sleeve 25 to turn over around the guiding shaft 253 toward the locking part 221 (locking tongue). The elastic segment 231 of the elastic spout 23 is folded along the bottom edge 255 of the fixing sleeve 25 to close the cavity, and the bottom edge 255 of the fixing sleeve 25 abuts the elastic segment 231 being contacted away from the locking tongue. The anti-off head 233 of the elastic spout 23 overlaps the fixing sleeve 25. The top edge 254 of the fixing sleeve 25 pull the anti-off head 233 of the elastic spout 23 to stretch towards the locking tongue. The fixing sleeve 25 overcomes the elastic force of the elastic spout 23 to enable the elastic spout 23 to fold. The elastic segment 231 of the elastic spout 23 is stretched in two opposite directions and in tension. The degree of stretch of the elastic segment 231 increases, as the rotation angle of the fixing sleeve 25 increases, and the tension of the elastic segment 231 is enhanced. That is, the elastic force to overcome the elastic spout 23 itself becomes greater. In the process of receiving the elastic spout 23, the guiding shaft 253 in the slideway 228 is driven by the tensioned elastic segment 231 to move towards the locking tongue. The transmission part 413 rotatably connected to the guiding shaft 253 drives the sliding plate 411 and the lock release button 42 to return to the position in the interlocked state. At the same time, the cover plate connected to the fixing sleeve 25 approaches to the locking tongue until the bump 241 comes into contact with the locking tongue. After the cover plate is pressed hard to make the bump 241 pass over the locking tongue, the elastic segment 231 in the tensioned state drives the top surface of the bump 241 to abut against the locking tongue and maintain in the interlocked state. The cover plate pushes the elastic spout 23 and the fixing sleeve 25 into the storage area 226, that is, the elastic spout 23 is in a folded storage state. And the elastic segment 231 closes the cavity by bending itself to prevent liquid from leaking out of the elastic spout 23.

When the elastic spout 23 is in the storage state, the user pushes the lock release button 42 along the force application direction F1 as shown in FIG. 2, and then drives the sliding plate 411 and the transmission part 413 to slide along the top surface of the lid body. The transmission part 413 links the guiding shaft 253 to slide away from the locking tongue in the slideway 228, and drives the fixing sleeve 25, the elastic spout 23 and the cover plate to move away from the locking tongue. The lock release drive mechanism 40 overcomes the elastic force of the elastic spout 23 until the cover plate completely comes out of the abutment area with the locking tongue. That is, the top surface of the cover plate is unlocked with the locking tongue. At this time, the liquid outlet of the elastic spout 23 is ejected from the storage area 226 because the elastic segment 231 of the elastic spout 23 recovers the deformation by its own elasticity, and the elastic spout 23 is in the storage or full release state. That is, the elastic segment 231 is in the unfolded state, and the cavity of the elastic segment 231 is opened. The user may drink the liquid in the cup 100 through the elastic spout 23.

The container 100 is configured to achieve the purpose of locking and releasing the elastic spout 23 by providing cooperation between the linking part 24, the elastic spout 23, the lock release drive mechanism 40 and the limiting seat 22, thus making the elastic spout 23 of the container 100 safer and more sanitary in installation and operation. The container 100 as a whole is easy to use and clean, and the service life of the container 100 may be extended accordingly.

Figure 8:
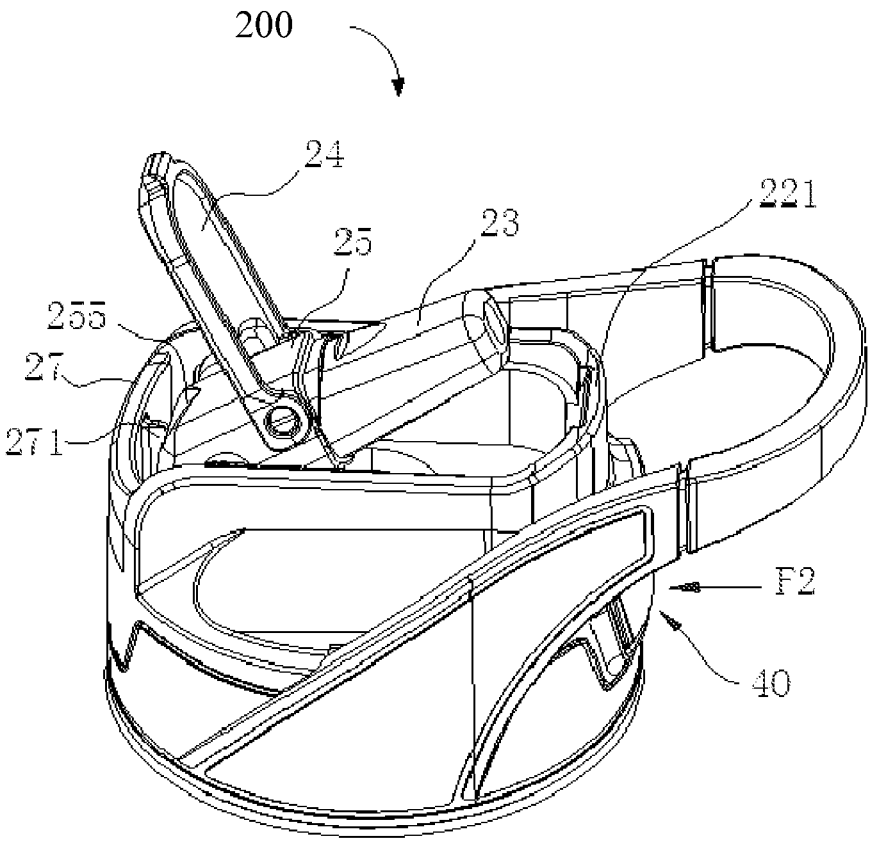
FIG. 8 is a perspective view of a lid of a container in another embodiment in a partial release state.
Figure 9:
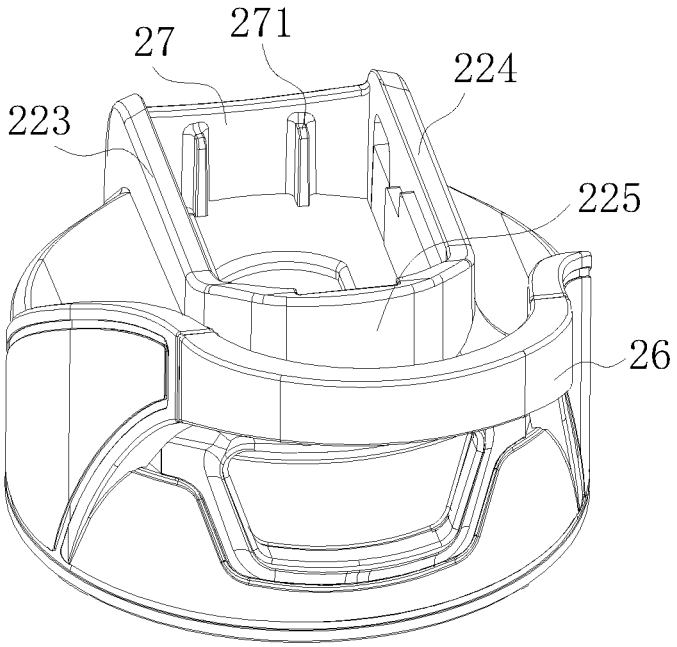
FIG. 9 is a perspective view of the lid of the container in FIG. 8 omitting the fixing sleeve and the elastic spout.
Figure 10:
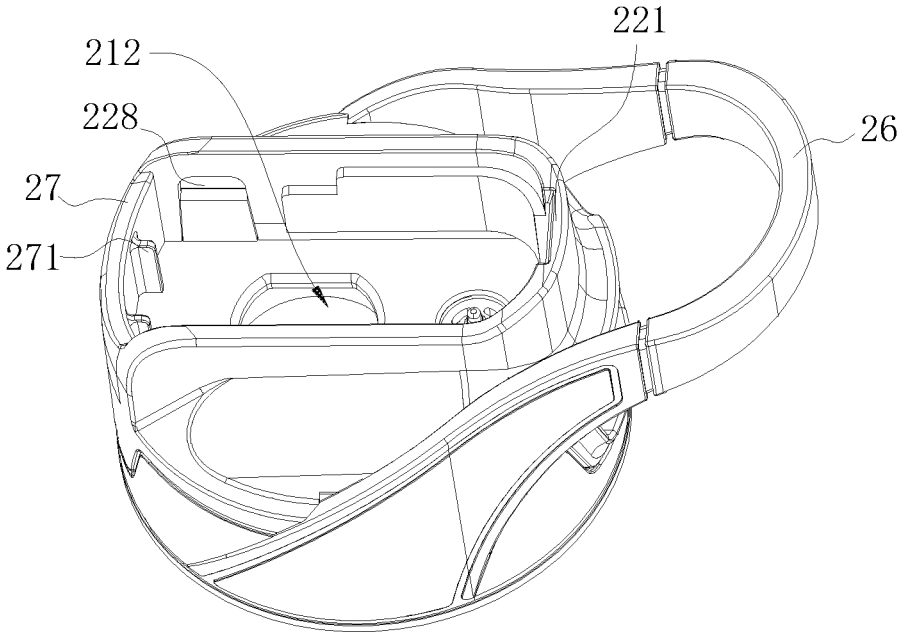
FIG. 10 is another perspective view of the lid of the container in FIG. 9.

Referring to FIGS. 8 to 10, another embodiment of a lid 200 connectable to a container body is shown. The lid 200 includes a lid body 21, a limiting seat 22, an elastic spout 23 and a linking part 24. The elastic spout 23 is connected to the lid body 21. The limiting seat 22 is provided with a locking part 221 that cooperates with the linking part 24. A lock release drive mechanism 40, which drives the linking part 24 and the locking part 221 to unlock, is slidably mounted on the lid body 21.

Figure 3:
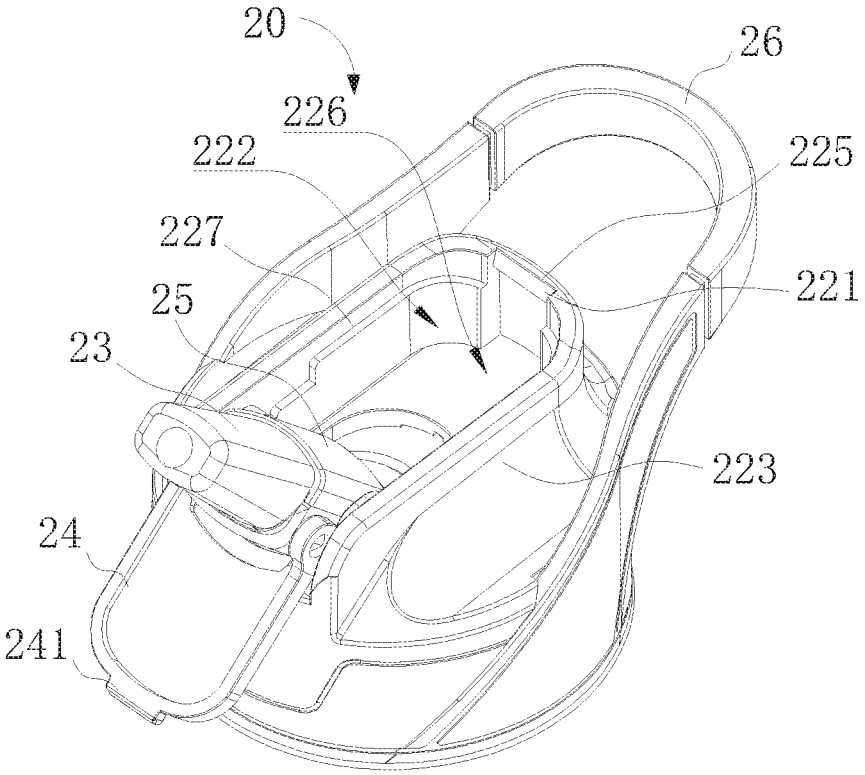
FIG. 3 is a perspective view of a lid of the container shown in FIG. 1.
Figure 4:
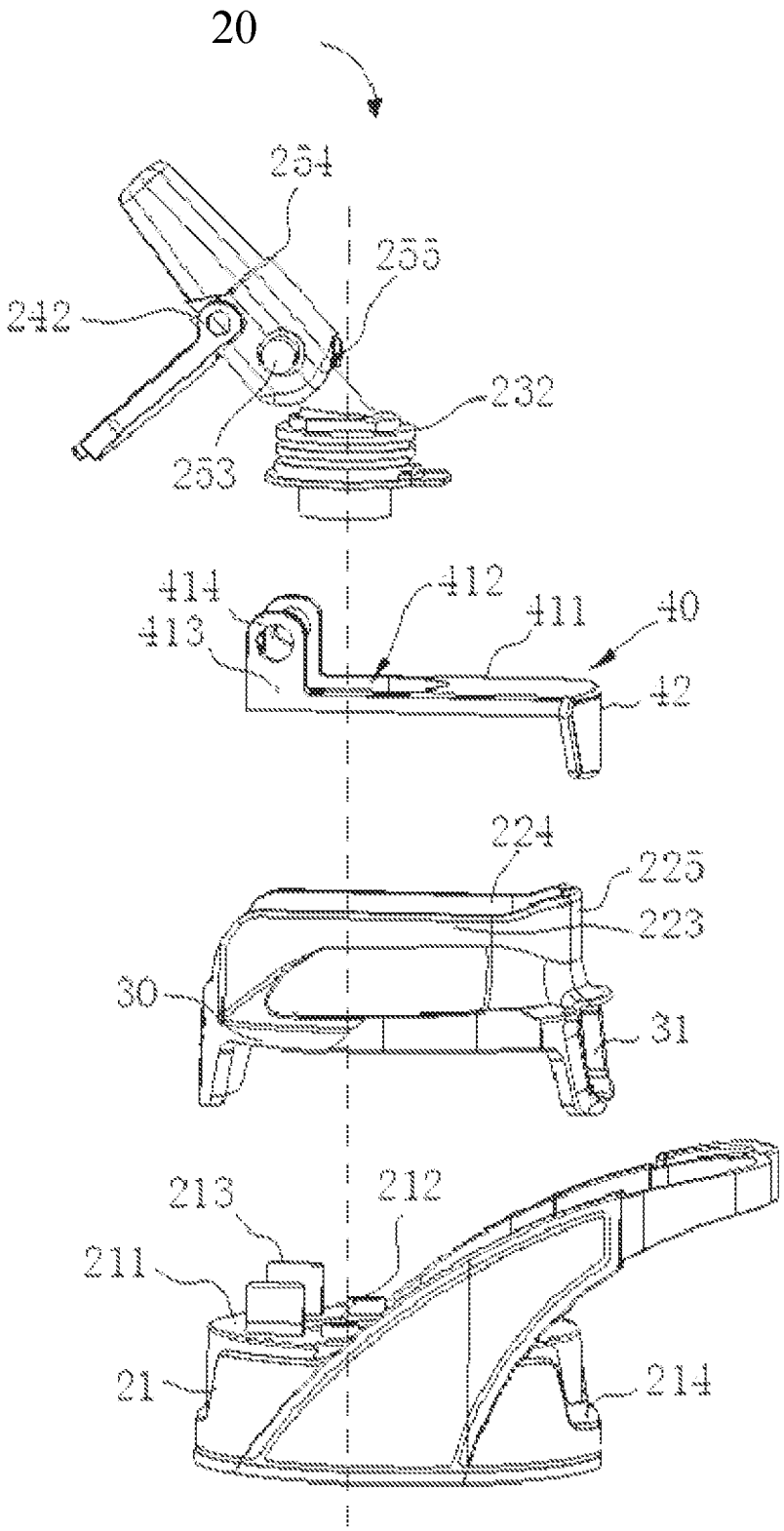
FIG. 4 is an exploded view of the lid shown in FIG. 3.
Figure 5:
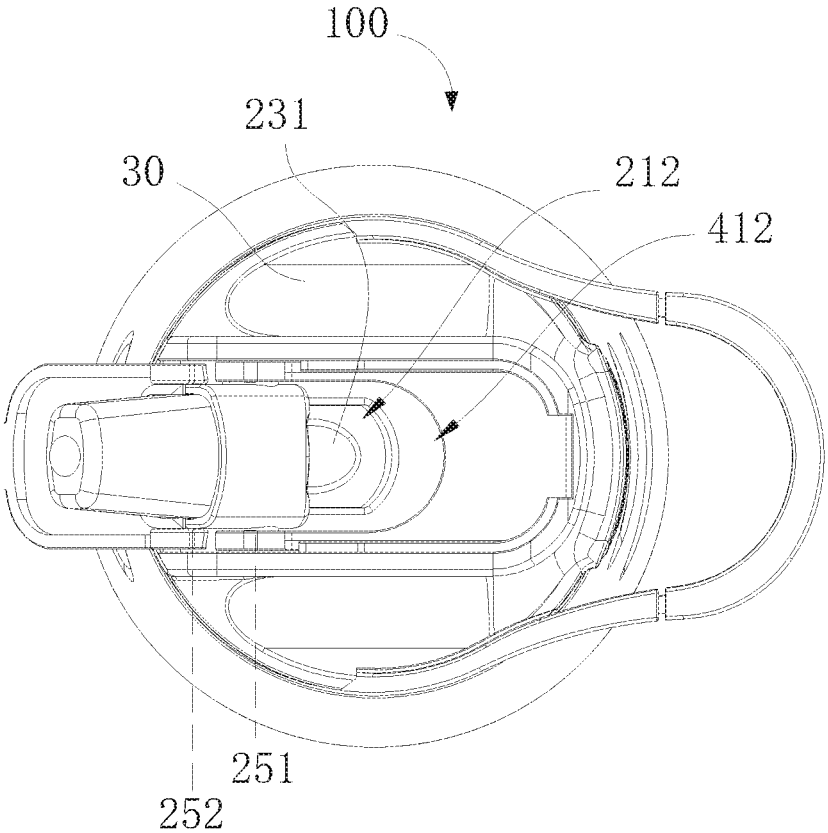
FIG. 5 is a top view of the container shown in FIG. 1.
Figure 6:
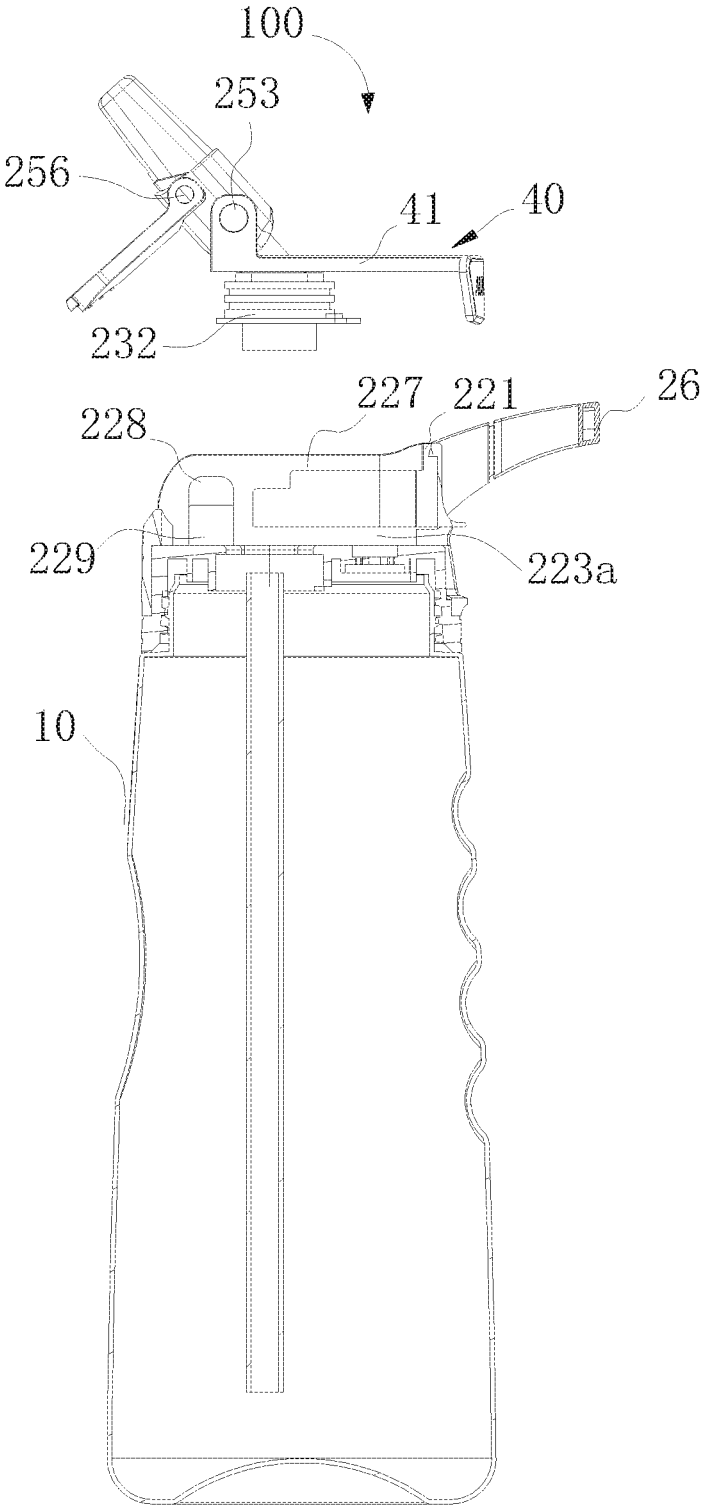
FIG. 6 is an exploded view of the container shown in FIG. 1.
Figure 7:
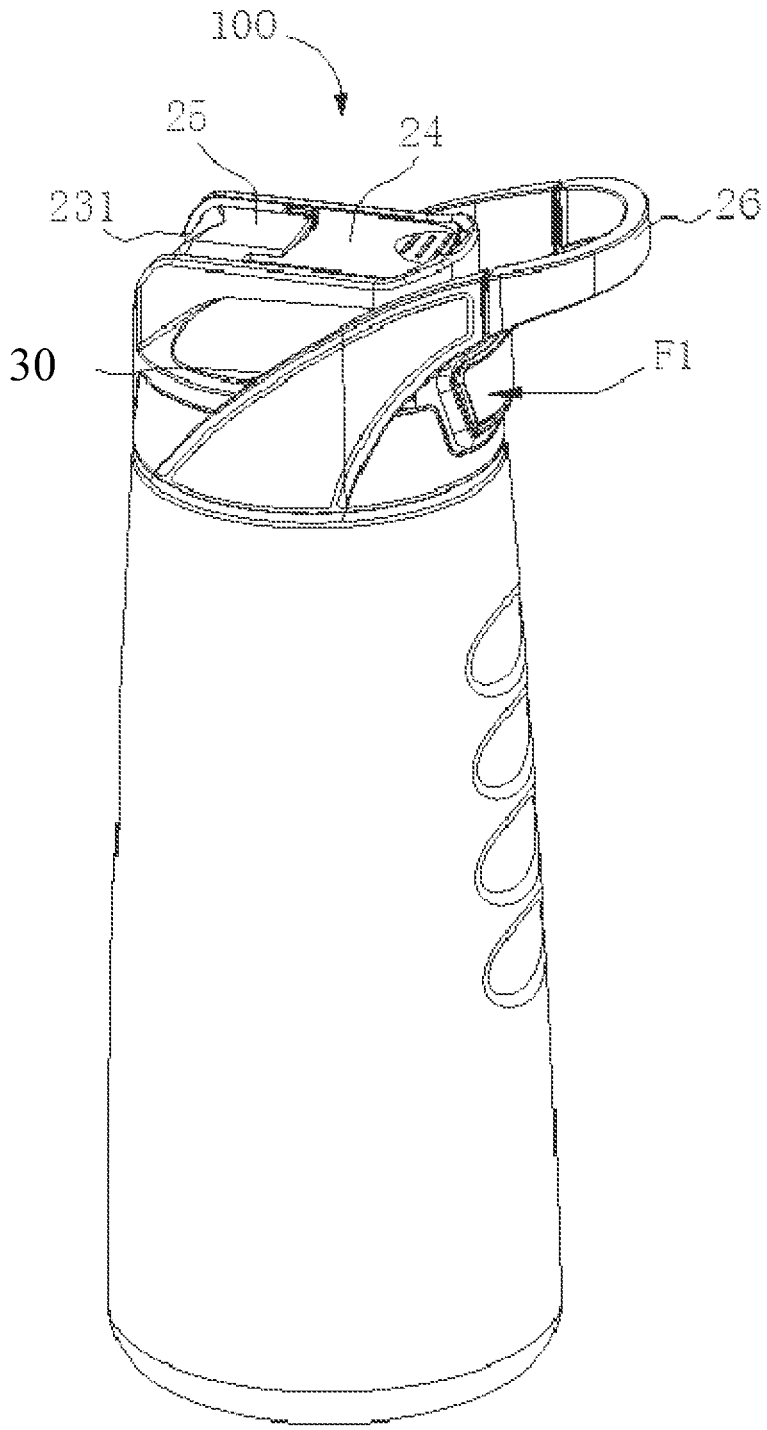
FIG. 7 is another perspective view of the container shown in FIG. 1 in the folded storage state.

The structure of the lid 200 share some features as that of the lid 20 in FIG. 3 except that the elastic spout 23 also has a partial release state between the full release state and the storage state. The limiting seat 22 further includes a limiting element 27 configured for limiting a rotating angle of the fixing sleeve 25. The elastic spout 23 further has the partial release state in which the limiting element 27 rotates within the rotating angle to enable the elastic spout 23 to be partially released. The elastic spout 23 reaches the partial release state before reaching the full release state. That is, the elastic spout 23 partially releases, preventing the linking part 24 from hitting a user's hand directly and the liquid in the container from ejecting.

The limiting element 27 can be located on an opening side of the U-shape structure 222. The limiting element 27 can be substantially plate shaped. One end of the limiting element 27 is fixedly connected to the first sidewall 223, and the other end of the limiting element 27 is fixedly connected to the second sidewall 224. The limiting element 27 is opposite to the third sidewall 225.

A surface opposite to the third side wall 225 of the limiting element 27 can extend towards the fixing sleeve 25 and form a limiting portion 271. The limiting portion 271 abuts the bottom edge 255 of the fixing sleeve 25.

The limiting portion 271 can have a substantially bar-type convex portion. In other embodiments, the limiting portion 271 can be wave shaped or have a protruding claw or the like, as long as it can abut the bottom edge 255 of the fixing sleeve 25 and limit the rotation angle of the fixing sleeve 25.

In the present embodiment, the limiting element 27 includes two limiting portions 271 arranged in parallel, which makes contact between the two limiting portions 271 and the bottom edge 255 of the fixing sleeve 25 more stable. In other embodiments, the number of the limiting portions 271 can be one or more.

The arrangement of the limiting portion 271 is one embodiment and may not be a necessary component in other embodiments. For example, the limit of the rotating angle of the fixing sleeve 25 can be achieved by frictional contact of the surface of the limiting element 27 with the fixing sleeve 25.

As shown in FIG. 10, movement of the elastic spout 23 from the partial release state to the full release state is explained below.

When an external force F2 drives the lock release drive mechanism 40 to remove the locking of the linking part 24 and the locking part 221, the elastic spout 23 will be partially released. The elastic spout 23 is interlocked with the fixing sleeve 25. The elastic spout 23 will self-recover and rotate, driving the fixing sleeve 25 to rotate correspondingly. After the fixing sleeve 25 rotates by a predetermined angle, the limiting portion 271 of the limiting element 27 abuts against the bottom edge 255 of the fixing sleeve 25, thereby placing the elastic spout 23 in the partial release state.

Specifically, the elastic spout 23 ejects from the area surrounded by the U-shaped structure 222 under the elastic force of the elastic segment 231 and drives the guiding shaft 253 of the fixing sleeve 25 to slide in the slideway 228. The bottom edge 255 of the fixing sleeve 25 will pull the elastic segment 231 away from the locking part 221. When the bottom edge 255 of the fixing sleeve 25 abuts on the limiting portion 271, the external force F2 still acts on the lock release drive mechanism 40. The lock release drive mechanism 40 keeps the fixing sleeve 25 and the limiting portion 271 in a state of being locked to each other to prevent the guiding shaft 253 from further sliding in the slideway 228, while the bottom edge 255 of the fixing sleeve 25 abuts the elastic segment 231 and further squeezing the limiting portion 271. The elastic segment 231 locked between the fixing sleeve 25 and the limiting portion 271 is in a tension state. The elastic spout 23 is in the partial release state. The elastic spout 23 turns over within an angle in a range of about 30 degrees to about 80 degrees from the storage state to the partial release state.

After the external force F2 is removed, the lock release drive mechanism 40 will release the fixing sleeve 25 and the limiting portion 271 from the state of being locked to each other. Under the elastic force of the elastic segment 231, the elastic segment 231 will recover the deformation away from the locking part 221 until the elastic spout 23 is in the full release state. The elastic spout 23 turns over within an angle in a range of about 100 degrees to about 160 degrees from the storage state to the full release state. In the process of the elastic spout 23 turning over, the elastic segment 231 of the elastic spout 23 will drive the bottom edge 255 of the fixing sleeve 25 to move towards the locking part 221.

The guiding shaft 253 of the fixing sleeve 25 further slides until the elastic segment 231 is fully released, and the liquid outlet is opened. At the same time, the elastic spout 23 is in the full release state, and the lock release drive mechanism 40 returns to a position as in the locked state under the function of the elastic spout 23.

The full release state of the elastic spout 23 refers to a state in which it is naturally deployed when no external force acts (as shown in FIG. 2). It can be understood that an angle between the elastic spout 23 in the full release state and the lid body 211 may be other angles, such as about 160 degrees or about 90 degrees, as long as the elastic spout 23 can recover the deformation in the full release state and the water outlet is open.

The limiting element 27 and the fixing sleeve 25 cooperate with each other such that the elastic spout 23 is in the partial release state between the full release state and the storage state. The two opening processes of the elastic spout 23 are provided, which will prevent the linking part 24 from hitting the user's hand directly and the liquid in the container from ejecting.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A container comprising a lid and a container body connected to the lid, the lid comprising a lid body, wherein the lid body is further provided an elastic spout extending away from the lid body and a limiting seat mounted at a top of the lid body; a linking part is mounted on the elastic spout, and a locking part cooperating with the linking part is disposed on the limiting seat; a lock release drive mechanism that drives the linking part and the locking part to be unlocked is slidably mounted on the lid body;

the elastic spout has a folded storage state, and the linking part and the locking part are interlocked with each other in the folded storage state;

the elastic spout also has a full release state in which the linking part is disengaged from the locking part to enable the elastic spout to be unfolded.

2. The container of claim 1, wherein the elastic spout is provided with a fixing sleeve, the fixing sleeve is rotatably mounted on the lid body, and the linking part is rotatably mounted on the fixing sleeve.

3. The container of claim 2, wherein the limiting seat is provided with a slideway, an outer wall of the fixing sleeve is provided with a guiding shaft extending into the slideway, and the guiding shaft is rotatably and slidably mounted in the slideway;

the linking part is released from the locking part by a movement of the guiding shaft in the slideway.

4. The container of claim 3, wherein two slideways are oppositely disposed, and two guiding shafts are respectively and slidably disposed in each of the slideways, and the two guiding shafts are disposed coaxially on radial sides of the fixing sleeve.

5. The container of claim 3, wherein the limiting seat has a U-shaped structure that is horizontally fixed on the top of the lid body, and the limiting seat comprises a first sidewall, a second sidewall, and a third sidewall, the first sidewall and the second sidewall are oppositely disposed and the third sidewall is connected between the first sidewall and the second sidewall; two slideways are respectively disposed adjacent to the first sidewall and the second sidewall, the locking part is disposed at the third sidewall, and the elastic spout is installed within an area surrounded by the U-shape structure.

6. The container of claim 3, wherein the lock release drive mechanism comprises a sliding support and a lock release button coupled to the sliding support, the sliding support being interconnected to the fixing sleeve, wherein the sliding support comprises a sliding plate that cooperates with the top surface of the lid body and a transmission part that is fixedly connected to the sliding plate and rotatably cooperated with the fixing sleeve; the lock release button is connected to a side edge of the sliding plate, and the lock release button is bent relative to the sliding plate and extends to an outer peripheral surface of the lid body.

7. The container of claim 6, wherein the transmission part comprises two supporting arms, and the two supporting arms are respectively provided with shaft holes; the two guiding shafts extend into the slideway after movably piercing through the corresponding shaft holes.

8. The container of claim 3, the elastic spout comprises a liquid inlet at an end and a liquid outlet at another end, the end with the liquid inlet is fixed to the lid body, the other end with the liquid outlet pierces through the fixing sleeve and an anti-off head subject to the fixing sleeve is disposed at a piercing portion.

9. The container of claim 8, wherein a rotation axis of the guiding shaft and a rotation axis of the linking part are parallel and offset from each other; the rotation axis of the linking part is closer to the liquid outlet of the elastic spout, compared to the rotation axis of the guiding shaft.

10. The container of claim 8, wherein the linking part is a cover plate, and the cover plate blocks the liquid outlet of the elastic spout when the elastic spout is in the folded storage state.

11. The container of claim 8, wherein at least one section of the elastic spout is an elastic segment for driving the elastic spout to be unfolded, and the elastic segment closes a cavity by self-bending when the elastic spout is in the folded storage state, a side of the fixing sleeve adjacent to the liquid outlet is a top edge and the anti-off head abuts the top edge, and another side of the fixing sleeve is a bottom edge, the elastic segment is bent around the bottom edge of the fixing sleeve and is in a tension state in the folded storage state; the elastic segment in the tension state drives the linking part and the locking part to be in an interlocked state.

12. The container of claim 1, wherein the locking part is a locking tongue that is abutted against the top surface of the linking part when being interlocked.

13. The container of claim 1, wherein the limiting seat further comprises a limiting element configured for limiting a rotating angle of the fixing sleeve, the elastic spout further has a partial release state in which the limiting element rotates within the rotating angle to enable the elastic spout to be partially released.

14. The container of claim 13, wherein the limiting element extends towards the fixing sleeve and forms a limiting portion, the limiting portion abuts the fixing sleeve and limits the rotation angle of the fixing sleeve, so that the elastic spout reaches the partial release state, and the lock release drive mechanism removes the abutment of the fixing sleeve from the limiting portion to enable the elastic spout to release from the partial release state to the full release state.

* * * * *